US009986323B2

(12) United States Patent
Armstrong et al.

(10) Patent No.: US 9,986,323 B2
(45) Date of Patent: May 29, 2018

(54) EARPHONES WITH ATTACHABLE EXPANSION PACK

(71) Applicant: LOGITECH EUROPE, S.A., Lausanne (CH)

(72) Inventors: Judd Armstrong, Parrearra (AU); Stephen Duddy, Moama (AU); Ahmad Shamsoddini, Salt Lake City, UT (US)

(73) Assignee: LOGITECH EUROPE, S.A., Lausanne (CH)

( * ) Notice: Subject to any disclaimer, the term of this patent is extended or adjusted under 35 U.S.C. 154(b) by 239 days.

(21) Appl. No.: 14/946,696

(22) Filed: Nov. 19, 2015

(65) Prior Publication Data

US 2017/0150245 A1 May 25, 2017

(51) Int. Cl.
*H04R 25/00* (2006.01)
*H04R 1/10* (2006.01)

(52) U.S. Cl.
CPC ..... *H04R 1/1025* (2013.01); *H04R 1/1016* (2013.01); *H04R 1/1041* (2013.01); *H04R 25/556* (2013.01); *H04R 25/602* (2013.01); *H04R 2225/31* (2013.01); *H04R 2420/09* (2013.01)

(58) Field of Classification Search
CPC .. H04R 1/1025; H04R 1/1041; H04R 25/554; H04R 25/556; H04R 25/558; H04R 25/602; H04R 2201/107; H04R 2225/31; H04R 2225/55; H04R 2499/11; H04R 1/1016; H04R 2420/09
USPC ..... 381/309, 315, 323, 328, 74, 331, 370, 381/374, 380, 384; 455/3.06, 90.3, 351, 455/569.1, 575.1
See application file for complete search history.

(56) References Cited

U.S. PATENT DOCUMENTS

| | | | |
|---|---|---|---|
| 2,189,096 | A | 2/1940 | Alonge |
| 3,543,724 | A | 12/1970 | Kirkpatrick et al. |
| 3,978,849 | A | 9/1976 | Geneen |
| 4,129,124 | A | 12/1978 | Thalmann |
| 4,224,984 | A | 9/1980 | Cramer et al. |
| 4,307,727 | A | 12/1981 | Haynes |

(Continued)

OTHER PUBLICATIONS

"Watch Stylish Blue Light LED Round Dial Matrix Stainless from ChinaBuye.com" by YnopoB. YouTube [dated Apr. 23, 2012][online][retrieved on Dec. 31, 2015] (https://www.youtube.com/watch?v=e_ LWbXHvvWg).

(Continued)

*Primary Examiner* — Huyen D Le
(74) *Attorney, Agent, or Firm* — Patterson & Sheridan, LLP

(57) ABSTRACT

A wearable device and methods for using the same provided. In one embodiment, a wearable device includes a pair of earphones with a controller and an expansion pack. The controller includes a first set of electrical contacts and a first set of modules. The expansion pack includes a second set of electrical contacts and a second set of modules. The controller is configured to electrically couple at least one module of the first set of modules to at least one module of the second set of modules when the controller is electrically coupled to the expansion pack. The expansion pack may further include a USB energy storage device to provide the earphones with an extended battery life when the expansion pack is coupled to the chargeable batteries of the controller.

19 Claims, 8 Drawing Sheets

(56) References Cited

U.S. PATENT DOCUMENTS

| | | | | |
|---|---|---|---|---|
| 4,331,154 | A | 5/1982 | Broadwater et al. | |
| 4,407,295 | A | 10/1983 | Steuer et al. | |
| 4,409,983 | A | 10/1983 | Albert | |
| 4,491,970 | A | 1/1985 | Lawhite et al. | |
| 5,301,154 | A | 4/1994 | Suga | |
| 5,392,261 | A | 2/1995 | Hsu | |
| 5,406,952 | A | 4/1995 | Barnes et al. | |
| 5,524,637 | A | 6/1996 | Erickson | |
| 5,734,625 | A | 3/1998 | Kondo | |
| 5,755,623 | A | 5/1998 | Mizenko | |
| 5,899,370 | A | 5/1999 | Bould | |
| 6,151,968 | A | 11/2000 | Chou | |
| 6,361,503 | B1 | 3/2002 | Starobin et al. | |
| 6,736,759 | B1 | 5/2004 | Stubbs et al. | |
| 7,192,401 | B2 | 3/2007 | Saalasti et al. | |
| 7,717,827 | B2 | 5/2010 | Kurunmaki et al. | |
| 7,914,425 | B2 | 3/2011 | Hanoun | |
| 8,027,638 | B2 * | 9/2011 | Sanguino | H04R 25/554 381/312 |
| 8,170,623 | B2 * | 5/2012 | Dorogusker | H02J 7/0054 455/569.1 |
| 8,688,174 | B2 * | 4/2014 | Latham | H04M 1/0258 381/370 |
| 8,992,385 | B2 | 3/2015 | Lemos | |
| 9,100,764 | B2 * | 8/2015 | Solum | H04R 25/556 |
| 2002/0151811 | A1 | 10/2002 | Starobin et al. | |
| 2002/0188210 | A1 | 12/2002 | Aizawa | |
| 2003/0065269 | A1 | 4/2003 | Vetter et al. | |
| 2005/0056655 | A1 | 3/2005 | Gary | |
| 2005/0116811 | A1 | 6/2005 | Eros et al. | |
| 2005/0256416 | A1 | 11/2005 | Chen | |
| 2006/0094349 | A1 * | 5/2006 | Slesak | H04B 1/08 455/3.02 |
| 2006/0183980 | A1 | 8/2006 | Yang | |
| 2007/0118043 | A1 | 5/2007 | Oliver et al. | |
| 2008/0086318 | A1 | 4/2008 | Gilley et al. | |
| 2008/0132383 | A1 | 6/2008 | Einav et al. | |
| 2008/0228089 | A1 | 9/2008 | Cho et al. | |
| 2009/0312656 | A1 | 12/2009 | Lau et al. | |
| 2010/0197463 | A1 | 8/2010 | Haughay et al. | |
| 2011/0021319 | A1 | 1/2011 | Nissila et al. | |
| 2011/0092790 | A1 | 4/2011 | Wilder-Smith et al. | |
| 2011/0260870 | A1 | 10/2011 | Bailey | |
| 2012/0022341 | A1 | 1/2012 | Zdeblick | |
| 2012/0168471 | A1 | 7/2012 | Wilson | |
| 2012/0253485 | A1 | 10/2012 | Weast et al. | |
| 2013/0064049 | A1 | 3/2013 | Pileri et al. | |
| 2013/0237778 | A1 | 9/2013 | Rouquette | |
| 2014/0032234 | A1 | 1/2014 | Anderson | |
| 2014/0073486 | A1 | 3/2014 | Ahmed et al. | |
| 2014/0107493 | A1 | 4/2014 | Yuen et al. | |
| 2014/0228175 | A1 | 8/2014 | Lemos et al. | |

OTHER PUBLICATIONS

"Elite Clock Military Style LED Watch" by ledwatchsuk. YouTube [dated May 31, 2011][online][retrieved on Aug. 14, 2015].

* cited by examiner

EARPHONES WITH ATTACHABLE EXPANSION PACK

TECHNICAL FIELD

The present disclosure relates generally to wearable electronic devices, and more particularly to battery powered earphones.

BACKGROUND

Previous generation wearable electronic devices require periodic charging in order to maintain acceptable power levels. This typically requires plugging the wearable device into a stationary power source, or at least a power source that is less mobile than the wearable device. One issue is that currently available wearable devices must be removed for conventional charging, or must at least be attached to a power source via cords. As such, conventional charging solutions do not allow for the full mobility and use of the wearable device while the device is charging. Moreover, in some cases, particularly where the wearable device is dependent on a power source to collect data continually and without interruption, conventional charging is problematic because it requires interrupting the data collection—typically by removing the device for charging, but also by loss of power. In other cases, where collecting data requires that the wearable device be highly mobile, connecting to a power source may impede data collection or use of the wearable device altogether.

BRIEF DESCRIPTION

In view of the above drawbacks, there is a long-felt need for wearable electronic devices that may be charged on the go, without being removed and without plugging into a power source. Further, there is a long-felt need for such devices to remain sleek, mobile, lightweight, readily manufacturable, and in some cases, rugged. In one embodiment of the disclosure, in which the wearable device is a wearable fitness-monitoring device, being sleek, mobile, lightweight, and/or rugged allows a user to perform numerous activities while wearing the device. Moreover, on-the-go charging enables continuous collection of data, such as data relating to the user's activity and the user's physical responses thereto, thus enabling the user to better track a multitude of fitness-and-health related data points. Additionally, there is a long-felt-need for wearable devices that are simple and cheap to manufacture.

Various embodiments of the present disclosure include a wearable device with an attachable expansion pack. In one embodiment, the wearable device includes earphones with a controller attached to each earphone via a cable and an attachable expansion pack. The controller may include a dock platform to receive the expansion pack, an electrical connector pin receptacle, and a first set of modules. The expansion pack may include a second set of modules and an electrical connector pin configured to be inserted into the electrical connector pin receptacle located on the controller. As such, when the expansion pack and the controller is electrically coupled, the first set of modules is electrically coupled to the second set of modules when the electrical connector pin of the expansion pack is inserted into the electrical pin receptacle of the controller. In other embodiments, the expansion pack may include an Universal Serial Bus (USB) energy storage device configured to connect to an external power supply and charge the USB energy storage device independently of the earphones. In this manner, the expansion pack may provide extended battery life when coupled to the earphones by providing stored charged voltage from the USB energy storage device to the earphones when the earphones and the expansion pack are electrically coupled.

Other features and aspects of the disclosed method and system will become apparent from the following detailed description, taken in conjunction with the accompanying drawings, which illustrate, by way of example, the features in accordance with embodiments of the disclosure. The summary is not intended to limit the scope of the claimed disclosure, which is defined solely by the claims attached hereto.

BRIEF DESCRIPTION OF THE DRAWINGS

The present disclosure, in accordance with one or more various embodiments, is described in detail with reference to the following Figures. The Figures are provided for purposes of illustration only and merely depict typical or example embodiments of the disclosure.

DETAILED DESCRIPTION

The technology disclosed herein is directed toward earphones. In addition to wirelessly receiving high-fidelity audio data for playback, the disclosed earphones may collect the user's biometric data such as heartrate data and movement data, and wirelessly transmit the biometric data to a computing device for processing and user-interaction using an activity tracking application installed on the computing device.

Figure 1:
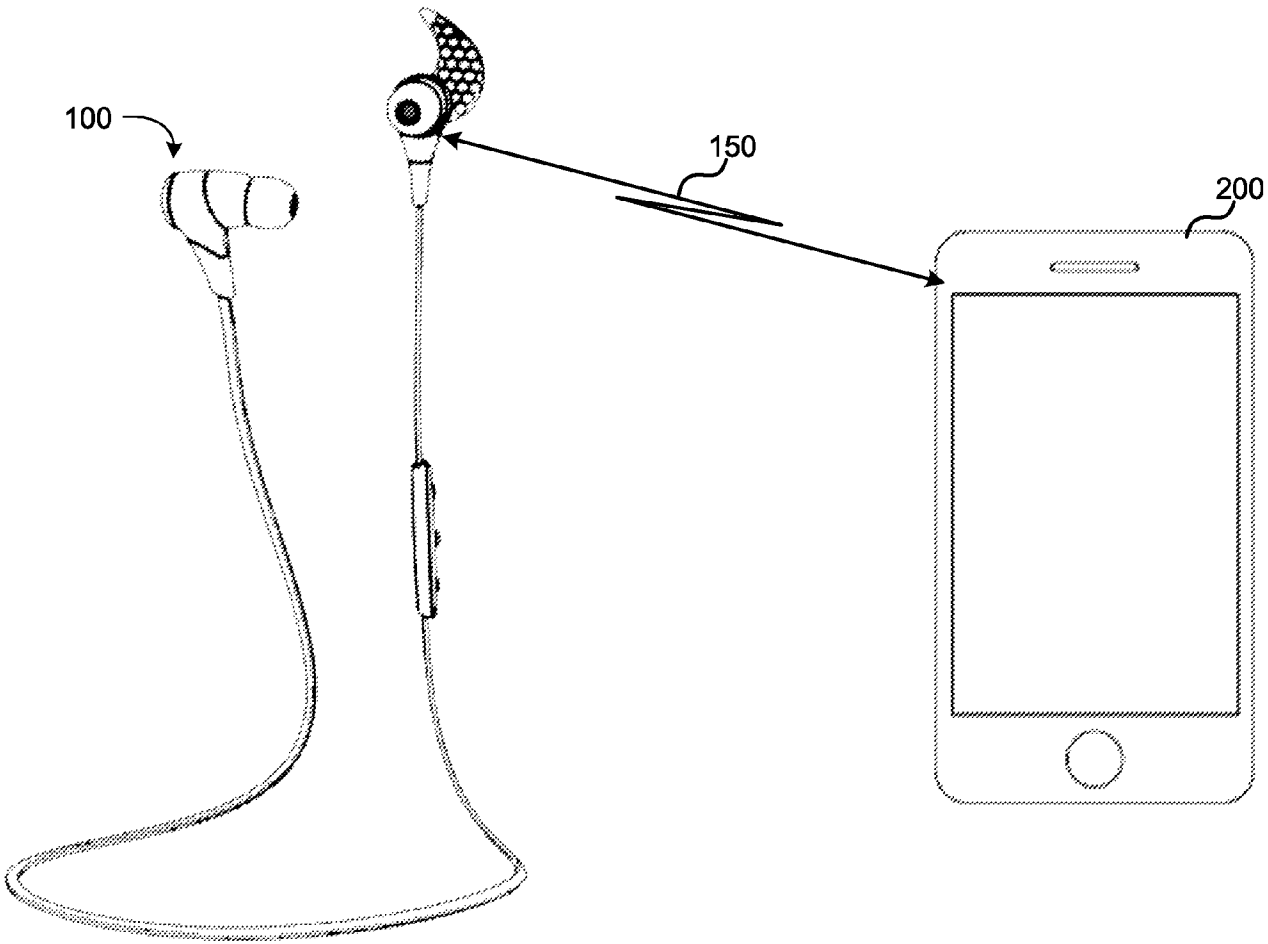
FIG. 1 illustrates an example communications environment in which embodiments of the disclosed technology may be implemented.

FIG. 1 illustrates an example communications environment in which embodiments of the disclosed technology may be implemented. In this embodiment, earphones 100 communicate biometric and audio data with computing device 200 over a communication link 150. The biometric data is measured by one or more sensors (e.g., heart rate sensor, accelerometer, gyroscope) of earphones 100. Although a smartphone is illustrated, computing device 200 may comprise any computing device (smartphone, tablet, laptop, smartwatch, desktop, etc.) configured to transmit audio data to earphones 100, receive biometric data from earphones 100 (e.g., heartrate and motion data), and process the biometric data collected by earphones 100. In additional embodiments, computing device 200 itself may collect additional biometric information that is provided for display. For example, if computing device 200 is a smartphone, it may use built in accelerometers, gyroscopes, and a GPS to collect additional biometric data.

Computing device 200 additionally includes a graphical user interface (GUI) to perform functions such as accepting user input and displaying processed biometric data to the user. The GUI may be provided by various operating systems known in the art, such as, for example, iOS, Android, Windows Mobile, Windows, Mac OS, Chrome OS, Linux, Unix, a gaming platform OS, etc. The biometric information displayed to the user can include, for example a summary of the user's activities, a summary of the user's fitness levels, activity recommendations for the day, the user's heart rate and heart rate variability (HRV), and other activity related information. User input that can be accepted on the GUI can include inputs for interacting with an activity tracking application further described below.

In preferred embodiments, the communication link 150 is a wireless communication link based on one or more wireless communication protocols such as BLUETOOTH, ZIGBEE, 802.11 protocols, Infrared (IR), Radio Frequency (RF), etc. Alternatively, the communications link 150 may be a wired link (e.g., using any combination of an audio cable, a USB cable, etc.)

Figure 2A:
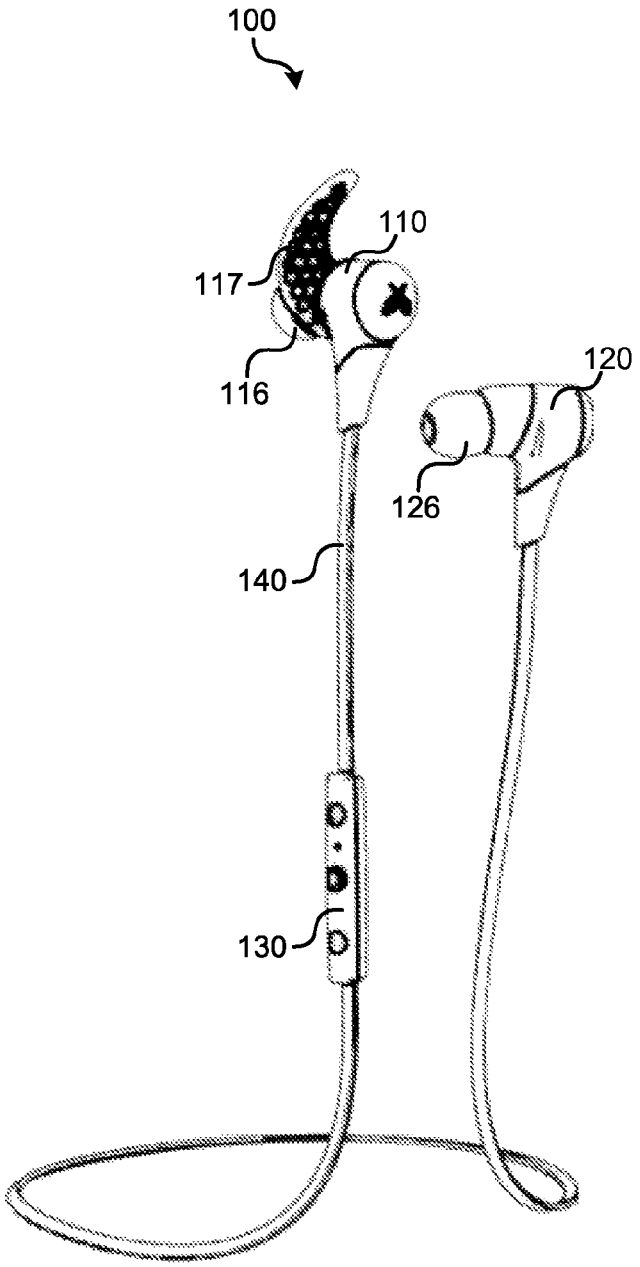
FIG. 2A illustrates a perspective view of exemplary earphones.

With specific reference now to earphones 100, FIG. 2A is a diagram illustrating a perspective view of exemplary earphones 100. FIG. 2A will be described in conjunction with FIG. 2B, which is a diagram illustrating an example architecture for circuitry of earphones 100. Earphones 100 comprise a right earphone 110 with tip 116, a left earphone 120 with tip 126, a controller 130 and a cable 140. Cable 140 electrically couples the right earphone 110 to the left earphone 120, and both earphones 110-120 to controller 130. Additionally, each earphone may optionally include a fin or ear cushion 117 that contacts folds in the outer ear anatomy to further secure the earphone to the wearer's ear.

In embodiments, earphones 100 may be constructed with different dimensions, including different diameters, widths, and thicknesses, in order to accommodate different human ear sizes and different preferences. In some embodiments of earphones 100, the housing of each earphone 110, 120 is rigid shell that surrounds electronic components. For example, the electronic components may include motion sensor 121, optical heartrate sensor 122, audio-electronic components such as drivers 113, 123, and speakers 114, 124, and other circuitry (e.g., processor 165 and memories 170, 175). The rigid shell may be made with plastic, metal, rubber, or other materials known in the art. The housing may be cubic shaped, prism shaped, tubular shaped, cylindrical shaped, or otherwise shaped to house the electronic components.

The tips 116, 126 may be shaped to be rounded, parabolic, and/or semi-spherical, such that it comfortably and securely fits within a wearer's outer ear, with the distal end of the tip contacting an outer rim of the wearer's outer ear canal. In some embodiments, the tip may be removable such that it may be exchanged with alternate tips of varying dimensions, colors, or designs to accommodate a wearer's preference and/or fit more closely to match the radial profile of the wearer's outer ear canal. The tip may be made with softer materials such as rubber, silicone, fabric, or other materials, as would be appreciated by one of ordinary skill in the art.

In some embodiments, controller 130 may provide various controls (e.g., buttons and switches) related to audio playback, such as, for example, volume adjustment, track skipping, audio track pausing, and the like. Additionally, controller 130 may include various controls related to biometric data gathering, such as, for example, controls for enabling or disabling heart rate and motion detection. In a particular embodiment, controller 130 may be a three button controller.

The circuitry of earphones 100 includes processor 165, memories 170 and 175, wireless transceiver 180, circuity for earphones 110 and earphone 120, and a battery 190. In this embodiment, earphone 120 includes a motion sensor 121 (e.g., an accelerometer or gyroscope), an optical heartrate sensor 122, and a right speaker 124 and corresponding driver 123. Earphone 110 includes a left speaker 114 and corresponding driver 113. In additional embodiments, earphone 110 may also include a motion sensor such as an accelerometer or gyroscope.

A biometric processor 165 comprises logical circuits dedicated to receiving, processing, and storing biometric information collected by the biometric sensors of the earphones. More particularly, as illustrated in FIG. 2, processor 165 is electrically coupled to motion sensor 121 and optical heartrate sensor 122, and receives and processes electrical signals generated by these sensors. These processed electrical signals represent biometric information such as the earphone wearer's motion and heartrate. Processor 165 may store the processed signals as biometric data in memory 175, which may be subsequently made available to a computing device using wireless transceiver 180. In some embodiments, sufficient memory is provided to store biometric data for transmission to a computing device for further processing.

During operation, optical heartrate sensor 122 uses a photoplethysmogram (PPG) to optically obtain the user's heart rate. In one embodiment, optical heart rate sensor 122 includes a pulse oximeter that detects blood oxygenation level changes as changes in coloration at the surface of a user's skin. More particularly, heartrate sensor 120 illuminates the skin of the user's ear with a light-emitting diode (LED). The light penetrates through the epidermal layers of the skin to underlying blood vessels. A portion of the light is absorbed and a portion is reflected back. The light reflected back through the skin of the user's ear is then obtained with a receiver (e.g., a photodiode) and used to determine changes in the user's blood oxygen saturation ($SpO_2$) and pulse rate, thereby permitting calculation of the user's heart rate using algorithms known in the art (e.g., using processor 165). In this embodiment, the optical sensor may be positioned on one of the earphones to face radially inward towards an earlobe when the earphones are worn by a human user.

In various embodiments, optical heartrate sensor 122 may also be used to estimate a heart rate variable (HRV), i.e. the variation in time interval between consecutive heartbeats, of the user of earphones 100. For example, processor 165 may calculate the HRV using the data collected by sensor 122 based on a time domain methods, frequency domain methods, and other methods known in the art that calculate HRV based on data such as the mean heart rate, the change in pulse rate over a time interval, and other data used in the art to estimate HRV.

In further embodiments, logic circuits of processor 165 may further detect, calculate, and store metrics such as the amount of physical activity, sleep, or rest over a period of time, or the amount of time without physical activity over a period of time. The logic circuits may use the HRV, the metrics, or some combination thereof to calculate a recovery score. In various embodiments, the recovery score may indicate the user's physical condition and aptitude for further physical activity for the current day. For example, the logic circuits may detect the amount of physical activity and the amount of sleep a user experienced over the last 48 hours, combine those metrics with the user's HRV, and calculate a recovery score. In various embodiments, the calculated recovery score may be based on any scale or range, such as, for example, a range between 1 and 10, a range between 1 and 100, or a range between 0% and 100%.

During audio playback, earphones 100 wirelessly receive audio data using wireless transceiver 180. The audio data is processed by logic circuits of audio processor 160 into electrical signals that are delivered to respective drivers 113 and 123 of left speaker 114 and right speaker 124 of earphones 110 and 120. The electrical signals are then converted to sound using the drivers. Any driver technologies known in the art or later developed may be used. For example, moving coil drivers, electrostatic drivers, electret drivers, orthodynamic drivers, and other transducer technologies may be used to generate playback sound.

The wireless transceiver 180 is configured to communicate biometric and audio data using available wireless communications standards. For example, in some embodiments, the wireless transceiver 180 may be a BLUETOOTH transmitter, a ZIGBEE transmitter, a Wi-Fi transmitter, a GPS transmitter, a cellular transmitter, or some combination thereof. Although FIG. 2 illustrates a single wireless transceiver 180 for both transmitting biometric data and receiving audio data, in an alternative embodiment, a transmitter dedicated to transmitting only biometric data to a computing device may be used. In this alternative embodiment, the transmitter may be a low energy transmitter such as a near field communications (NFC) transmitter or a BLUETOOTH low energy (LE) transmitter. In implementations of this particular embodiment, a separate wireless receiver may be provided for receiving high fidelity audio data from an audio source. In yet additional embodiments, a wired interface (e.g., micro-USB) may be used for communicating data stored in memories 170 and 175.

Figure 2B:
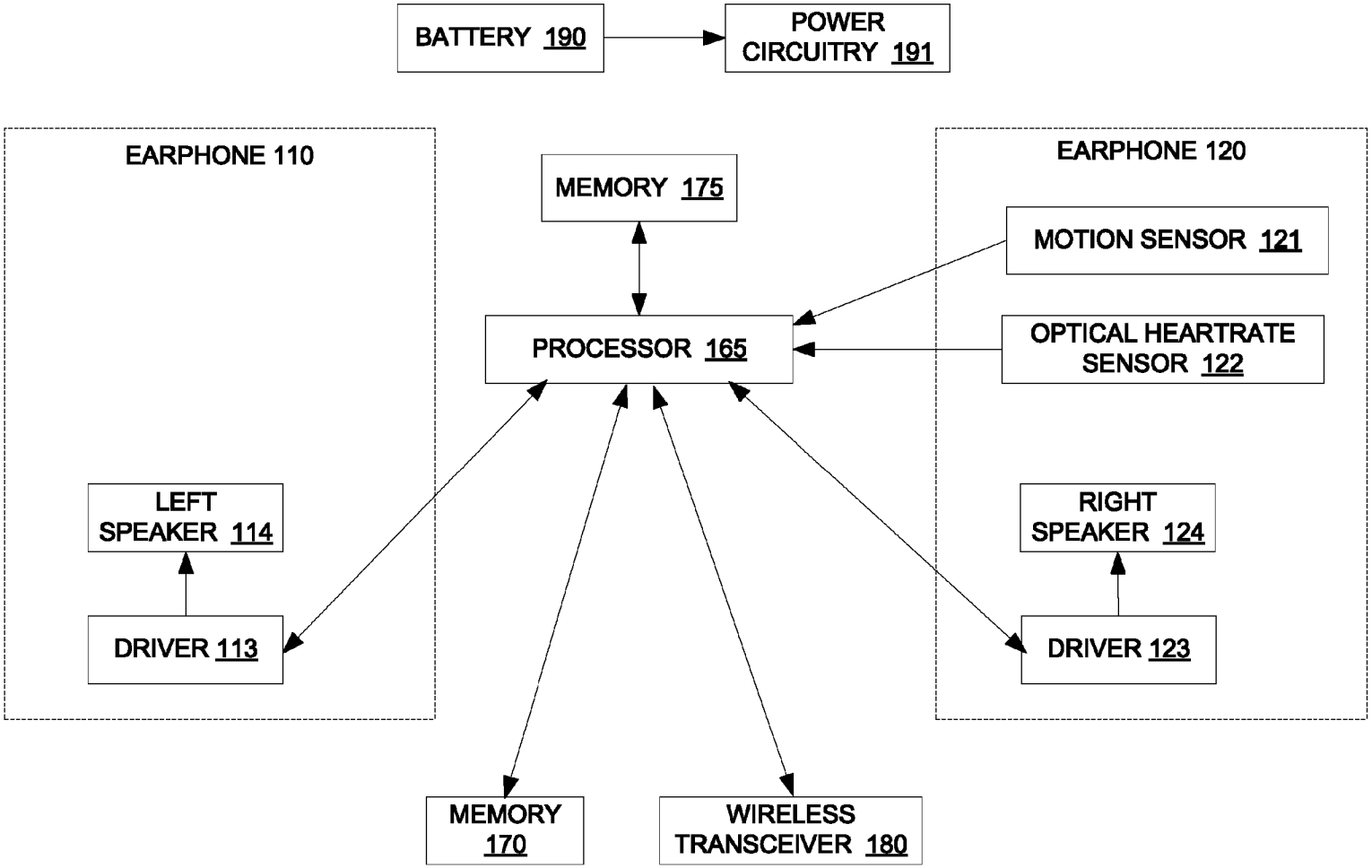
FIG. 2B illustrates an example architecture for circuitry of the earphones of FIG. 2A.

FIG. 2B also shows that the electrical components of headphones 100 are powered by a battery 102 coupled to power circuity 191. Any suitable battery or power supply technologies known in the art or later developed may be used. For example, a lithium-ion battery, aluminum-ion battery, piezo or vibration energy harvesters, photovoltaic cells, inductor charger, USB battery charger, or other like devices can be used. In embodiments, battery 102 may be enclosed in earphone 110, earphone 120, or enclosed in the controller 130 connected to each earphone 110 and 120 via a cable. Alternatively, an expansion pack (not shown but described in greater detail below) may house an energy storage device, such as a battery, to be coupled to the controller 130 to power the earphones 110, 120.

In certain embodiments, the circuitry within the expansion pack may be configured to enter a low-power or inactive mode when earphones 100 are not in use. For example, mechanisms such as, for example, an on/off switch, a BLUETOOTH transmission disabling button, or the like, may be provided on controller 130 such that a user may manually control the on/off state of power-consuming components of earphones 100.

It should be noted that in various embodiments, processor 165, memories 170 and 175, wireless transceiver 180, and battery 190 may be enclosed in and distributed throughout any one of earphone 110, earphone 120, and controller 130. For example, in one particular embodiment, processor 165 and memory 175 may be enclosed in earphone 120 along with optical heart rate sensor 122 and motion sensor. In this particular embodiment, these four components are electrically coupled to the same printed circuit board (PCB) enclosed in earphone 120. It should also be noted that although audio processor 160 and biometric processor 165 are illustrated in this exemplary embodiment as separate processors, in an alternative embodiment, the functions of the two processors may be integrated into a single processor.

Figure 3B:
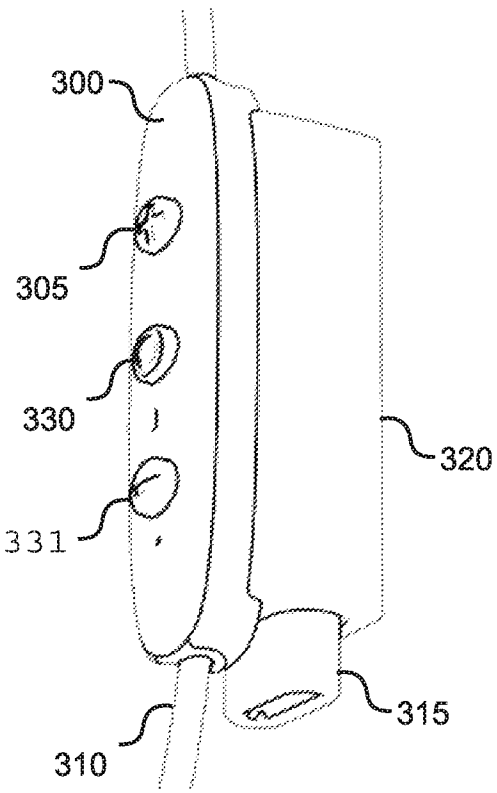
FIG. 3B illustrates a perspective view of an example earphone controller in attached configuration with an attachable expansion pack.
Figure 3A:
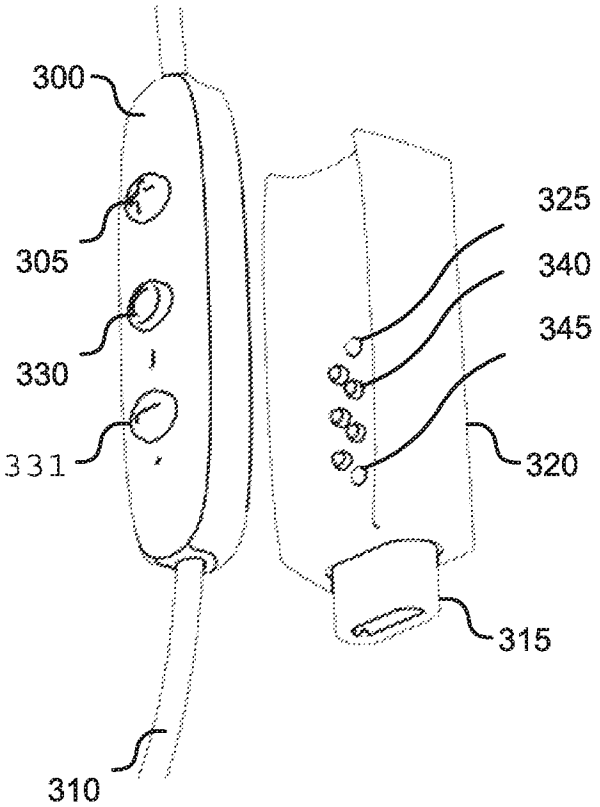
FIG. 3A illustrates a perspective view of an example earphone controller in detached configuration with a detachable expansion pack.

FIG. 3A illustrates a perspective view of an example earphone controller 300 in detached configuration with an attachable expansion pack 320. FIG. 3A will be described in conjunction with FIGS. 3B and 3C, which show various perspective views illustrating example arrangements of the controller 300 and the expansion pack 320. As illustrated, a controller 300 is connected to each earphone 110, 120 via a cable 310 such that an expansion pack 320 may be attached to the backside of the controller. The controller may include various control buttons 305, 330, 331 to control or adjust various functions of the earphones. By way of example only, control button 305 may increase the audio volume and control button 331 may decrease the audio volume projected from the earphones 100. By way of another example only, control button 330 may play/pause the audio by clicking or tapping the button once or even fast forward a song when the control button 330 is tapped twice quickly. However, it should be noted that the buttons 305, 330, 331 are not merely limited to increasing volume or pausing/fast forwarding audio. Instead, control buttons 305, 330, 331 may provide a variety of control functions (e.g., receive incoming call, ignore incoming call, capture a photo, record biometric data, enable or disable heart rate and motion detection, etc.) depending on the type of computing device the earphone is configured to communicate biometric and/or audio data over communication link 150. Furthermore, controller 300 may include various buttons that are not limited to a three button controller, and instead, may include one button, two buttons, four buttons, etc.

In one embodiment, the earphones 100 may include one or more modules that may be in the form of electronic capsules embedded in the cavities within the controller 300. Such modules may include devices such as accelerometers, gyroscopes, processors, logic circuits, biosensors, optical sensors, batteries, circuit boards, modems, amplifiers, wireless transceivers (e.g., GPS, Wi-Fi, Bluetooth, cellular, etc.), integrated circuits, antennae, and the like.

Referring back to FIG. 3A, in one embodiment of earphones 100, the attachable expansion pack 320 may be configured to attach or couple to the back side of the controller 300. The expansion pack 320 may be made of similar material as the controller 300 (e.g., silicone, plastic, and the like) that is suitable and durable for use during a number of activities, which may include athletic activities, exercise, work, eating, sleep, and so on. As further depicted in the illustrated embodiment, the expansion pack 320, may generally be a rectangular shape so as to conform to the general rectangular shape of the illustrated controller 300. In different instances, the expansion pack 320 may take on any number of various shapes and forms.

In one embodiment, the controller 300 may include one or more modules that may be in the form of electronic capsules embedded within the controller 300. Such modules may include devices such as accelerometers, gyroscopes, processors, logic circuits, biosensors, optical sensors, batteries, circuit boards, modems, amplifiers, wireless transceivers (e.g., GPS, Wi-Fi, Bluetooth, cellular, etc.), integrated circuits, antennae, and the like.

FIG. 3B illustrates a perspective view of an example earphone controller 300 in attached configuration with an attachable expansion pack 320. In some embodiments, the controller 300 may include a dock platform 350 on the back side of the controller configured to receive the expansion pack 320, such that controller 300 and the expansion pack 320 may be coupled in a streamlined manner. Furthermore, configuring the dock platform to receive and house the expansion pack 320 in a streamlined manner allows the expansion pack 320 to be used with the controller 300 without adding significant bulk, further allowing the expansion pack to be attached to the controller 300 while the earphones are being worn by a user during a wide variety of activities (e.g., athletic activities, exercise, work, eating, sleep, etc.). However, in the instance that the expansion pack 320 is not coupled to the controller 300, a dock cover (not shown here) may cover and protect the exposed dock platform from impacts, scratches, and the like while also maintaining a streamlined shape of the controller 300. The dock cover may attach onto the controller 300 by a wide variety of attachment mechanisms, such as sliding on a hinge, clasping onto a latch mechanism, etc. Moreover, when the expansion pack 320 is not coupled to the controller 300, the dock platform may be used as storage for other items, such as additional sensors, memory storage devices, and the like.

Referring again to FIG. 3A, in the illustrated embodiment, the electrical contacts 340 are depicted as being located on the expansion pack 320. In various embodiments, however, the electrical contacts 340 may be located in various positions on the expansion pack 320, such as on any edge of the expansion pack 320, or any inner-facing surface of the expansion pack 320. Moreover, although FIG. 3A depicts the first set of electrical contacts 340 as being located on the same edge or surface as each other and as proximal to one another, the first set electrical contacts 340 may be located in different locations of the expansion pack 320 relative to one another. While the exemplary FIG. 3A depicts four electrical contacts 340, the number of electrical contacts 340 may include any number of electrical contacts (e.g., one, two, three, five, ten electrical contacts, etc.), while other expansion packs 320 may have no electrical contacts 340 that are omitted from the expansion pack 320 altogether.

Figure 3C:
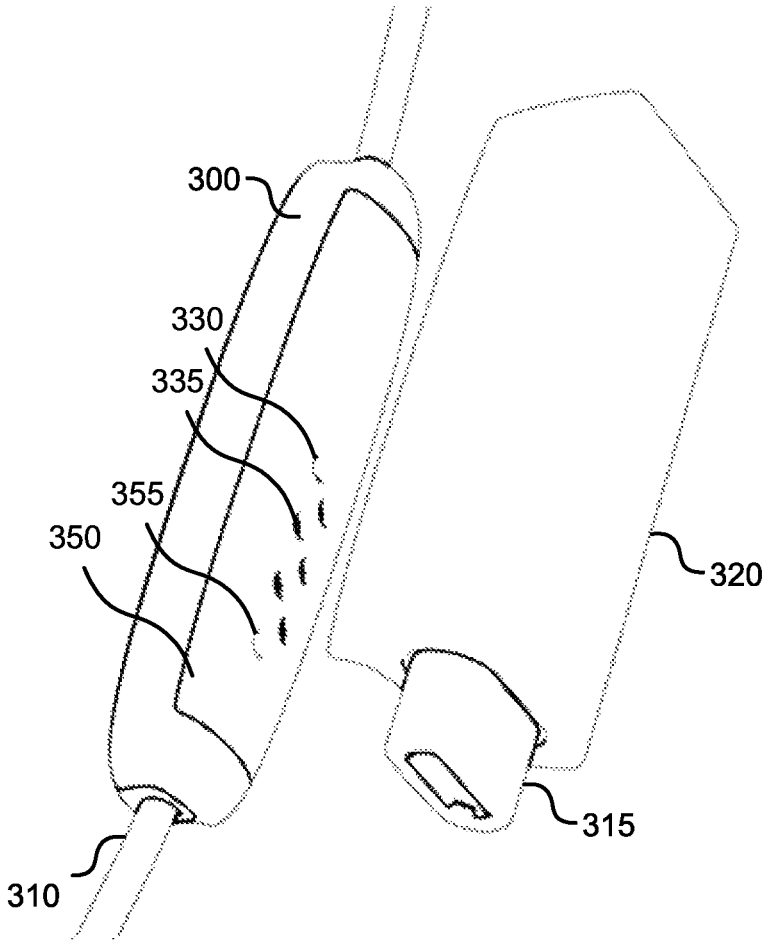
FIG. 3C illustrates a back perspective view of an example earphone controller in detached configuration with an attachable expansion pack.

Additionally, the first set of electrical contacts 340 may generally include material that conducts electricity. In one embodiment, the first set of electrical contacts 340 connect various electronic components or modules housed in the expansion pack 320 to various electronic components or modules housed in the earphones 100 or controller 300 via any one of the plural electrical contacts 335 as depicted in exemplary illustration FIG. 3A. By way of example, the first set of electrical contacts 340 may be an exposed portion of metal located on the inner surface of the expansion pack 320, where the exposed portion of metal may be electrical connector pin 340. As depicted in FIGS. 3A and 3C, first set of electrical contacts 340 located on the expansion pack 320 may be configured to contact second set of electrical contacts 335 located on the controller 300. The second set of electrical contacts 335 may be located in various positions on the dock platform 350 of the controller 300, such as on any edge of the dock platform 350 or any outer-facing surface of the controller 300. Moreover, although FIG. 3C depicts the second set of electrical contacts 335 as being located on the same edge or surface as each other and as proximal to one another, the second set electrical contacts 335 may be located in different locations of the controller 300 relative to one another. Additionally, the first set of electrical contacts 340 may generally include material that conducts electricity. While the exemplary FIG. 3C depicts four electrical contacts 335, the number of electrical contacts 335 may include any number of electrical contacts (e.g., one, two, three, five, ten electrical contacts, etc.), while other controllers 300 may have no electrical contacts 340 altogether.

In some embodiments, the first set of electrical contacts 345 on the expansion pack 320 is an electrical connector pin configured to mate to the corresponding second set of electrical contacts 335 on the controller, which is an electrical connector pin receptacle. The electrical connector pin 340 may mate to the corresponding electrical connector pin receptacle 335 to ensure that a proper electrical connection is established between the expansion pack 320 and the dock platform 350 of the controller 300. In some instances, a click sound may be heard when the electrical connector pin 340 in properly and securely inserted into the electrical connector pin receptacle 335.

Referring back to exemplary FIG. 3A, the expansion pack 320 and the controller 300 may include markings that further guide the alignment of the expansion pack 320 and the controller 300. As illustrated, the expansion pack 320 may include a set of alignment guides 325, 345 to further help guide and align the expansion pack 320 to the controller 300. As further depicted in FIG. 3C, the first alignment guides 325, 345 may include a first set of magnets that attracts to the second alignment guides 330, 355 that may include a second set of magnets located on the dock platform 350 of the controller 300, further allowing the expansion pack 320 to magnetically guide and fasten onto the controller 300.

In other embodiments, the alignment guides 325, 345 may not be made of magnetic material, but instead, may include other means for aligning the expansion pack 320 to the controller 300, such as a guide pin or flange extending from the expansion pack 320 to be inserted into the corresponding slot or receptacle located on the dock platform 350 of the controller 300. The guide pin or flange may mate to the corresponding slot to ensure that the expansion pack 320 and the controller 300 are properly aligned and fastened. In some embodiments, a click sound may be heard when the expansion pack 320 and the controller 300 are successfully coupled via the first and second set of alignment guides 325, 345, 330, and 355.

Additionally, the electrical connector pin 340 and the electrical connector pin receptacle 335 may also be made of magnetic material so as to function as electromagnetic contacts. In such an embodiment, the electrical connector pin 340 may make an electromagnetic contact with the corresponding electrical connector pin receptacle 335 to ensure that a proper electrical connection is established. Thus, when the expansion pack 320 is brought into a position proximal to the controller 300, the magnetic material of the electrical connector pin 340 may attract the magnetic material of the electrical connector pin receptacle 335 allowing the expansion pack 320 and the controller 300 to magnetically fasten. Upon studying the present disclosure, one of skill in the art will appreciate that, in some embodiments, electrical contacts may function as electromagnetic contacts. In other embodiments, the electromagnetic contacts may function as or be referred to as electrical contacts herein, though an electrical contact need not be made from magnetic material.

Furthermore, expansion pack 320 in various embodiments, houses various components, devices, and/or modules. For example, expansion pack 320 may house an energy storage device, such as a battery; circuitry capable of receiving and transmitting wireless signals, including, for example, cellular signals (e.g., LTE, WiMAX, CDMA, GPS, etc.), Wi-Fi, Bluetooth, TV or radio broadcast signals, and so on; memory circuits (e.g., RAM, flash storage, or other solid-state memory); processing circuits (e.g., an applications processor or a portion thereof); sensors (e.g., gyroscope, accelerometer, hygrometer, altimeter, temperature sensor, and so on); and the like. Such components, devices, and modules may couple to circuitry and other components, devices, modules, displays, etc. in earphones 100 by way of electrical contacts 335, 340 and/or electromagnetic contacts when electromagnetic contacts are used. Moreover, expansion pack 320 may include additional electrical and electromagnetic contacts in embodiments in which additional input/output capabilities are required (and controller 300) may include additional corresponding contacts as well. In addition, expansion pack modules may be communicatively coupled to controller 300 modules via a communication medium.

In one embodiment, expansion pack 320 houses a first energy storage device. The first energy storage device may store electrical charge, and transfer the energy to a second energy storage device such that the second energy storage device is capable of having an extended battery life. As such, the first and second energy storage devices are first and second batteries, and the first battery charges the second battery. In one particular embodiment, the first energy storage device may be housed within expansion pack 320 and the second battery may be housed within controller 300, such that the electrical coupling of the expansion pack 320 to the dock platform 350 of the controller 300 allows the first battery to charge to the second battery. The expansion pack 320 may include a voltage boost circuitry to provide an output voltage greater than the provided input voltage so that high output voltage may be generated from a low input power supply. The voltage boosting circuity in the expansion pack 320 may further provide the generated charging voltage to the second battery of the controller 300, further providing power to the earphones 100.

In one embodiment, the internal battery of the expansion pack 320 may be configured to include an Universal Serial Bus (USB) energy storage device The USB plug 315 of the energy storage device may be fitted to a corresponding USB 1, USB 2, or USB 3 port connected to a main power source to charge the USB energy storage device. In other instances, the USB plug 315 may be fitted into a corresponding adapter so that the USB plug 315 may be appropriately coupled to a wide variety of electric power sources. In this matter, the expansion pack 320 can be used as a convenient way to charge a depleting battery (i.e., the second battery, in this instance) housed within controller 300 connected to a pair of earphones 100.

In one embodiment, the USB energy storage device may include a first internal battery housed within the expansion pack 320 to recharge a second internal battery of the controller 300, which may provide an extended battery life for earphones 100 when the expansion pack 320 is electrically coupled to the controller 300. More specifically, the expansion pack 320 may be fastened and aligned (i.e., the electrical contacts 340 between the expansion pack 320 and the controller 300), allowing the first battery (in expansion pack 320) to charge the second battery (in controller 300) from the electrical current flowing through first set of electrical contacts 340 (expansion pack) to the second set of electrical contacts 335 (controller). Similarly, when expansion pack 320 includes additional modules or devices, electrical contacts 340 may also be used as input/output terminals for various signals (e.g., wireless, data, sensor, etc.), as may the communication medium.

As an attachable charging device for modules embedded within controller 300, various embodiments of expansion pack 320 allow for power utilization without interruption for charging. On-the-go charging enables continuous monitoring and data-gathering for applications such as monitoring sleep, medical conditions, health, and activity (or other vitals). Such continuous monitoring provides for a robust data set that would not be achievable with a device that must be detached for charging. In other instances, on-the-go charging provides the convenience of using an electrical device without having to worry about the loss of power.

In one embodiment, the internal battery of the expansion pack 320 may be charged independently of the earphones 100 so that the expansion pack 320 alone is inserted into a corresponding USB port to charge the energy storage device housed within the expansion pack 320. In other instances, the expansion pack 320 may be coupled to the controller 300 as the USB plug 315 of the expansion pack 320 is inserted into a corresponding USB port. In this matter, both the first battery (located in the expansion pack) and the second battery (located in the controller) may be simultaneously charging. In other words, expansion pack 320 may charge the first battery by drawing electrical current from a main power source via the USB plug 315, while the second battery housed within the controller 300 is also simultaneously being charged by drawing electrical current from the coupled expansion pack 340 via electrical connections 340, 335 when the expansion pack 320 is coupled to the controller 300. As such, even in the instance the internal battery of the expansion pack 320 is depleted, the internal battery of the controller may continuously charge and draw electrical current when the controller 300 is coupled to the expansion pack 320 attached to a main power source.

In other instances, the expansion pack 320 may be detached from a main power source and coupled to the controller 300. In this instance, the charging voltage stored in the internal battery of the expansion pack 320 is transferred to the internal battery of the controller 300 via the first and second electrical contact sets 340, 335 and provides power to the earphones 100. The expansion pack 320 provides an extended battery life to the internal battery housed within the controller 300 that does not impede the functionality or use of the earphones 100 regardless of whether the expansion pack 320 is attached or detached from the controller 300.

Further embodiments of the disclosure include a ruggedized wearable device. In some such embodiments, the dock platform may be utilized to streamline the form factor of the controller 300 of the earphones 100 with the expansion pack 320 when the expansion pack 320 is fastened to the controller 300. Moreover, in other instances, stronger fastening means, such as stronger magnets, claps, or mating components are used to create a stronger and more secure coupling between the expansion pack 320 and the controller 300. In additional scenarios, the expansion pack 320 may be configured to form a seal with controller 300 around the outer edges of the expansion pack 320 when the expansion pack 320 is fastened or coupled to the controller 300. The seal may be used to keep dirt, water, and the elements from corrupting or otherwise affecting the connections between the expansion pack 320 and the controller 300. In further embodiments, the controller 300 includes additional fastening means (e.g., clamps, frictional seal, etc.) that, in addition to the magnetic coupling, provide a stronger mechanical connection between the expansion pack 320 and the controller 300.

Figure 4:
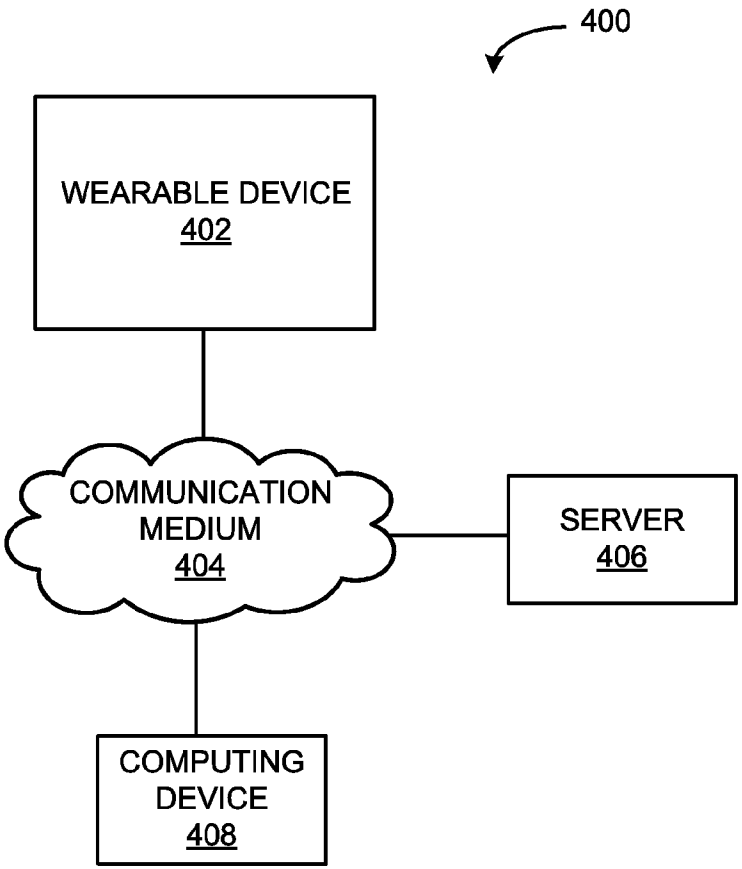
FIG. 4 illustrates a schematic block diagram of an example wearable device.

FIG. 4 is a schematic block diagram illustrating example system 400, which represents an operating environment for an example embodiment of wearable device 402. As illustrated, system 400 includes wearable device 402, communication medium 404, computing device 408, and server 406. Wearable device 402, in various embodiments, may include earphones 100 as discussed above.

Communication medium 404 connects wearable device 402 to various other systems and modules, represented by computing device 408 and server 406. Communication medium 404 may be implemented in a variety of forms. For example, communication medium 404 may be an Internet connection, such as a local area network ("LAN"), a wide area network ("WAN"), a fiber optic network, internet over power lines, a hard-wired connection (e.g., a bus), and the like, or any other kind of network connection. Communication medium 404 may be implemented using any combination of routers, cables, modems, switches, fiber optics, wires, radio, and the like. Communication medium 404 may be implemented using various wireless standards, such as Bluetooth, Wi-Fi, 4G LTE, etc. One of skill in the art will recognize other ways to implement communication medium 404 for communications purposes.

Computing device 408 may take a variety of forms, such as a desktop or laptop computer, a smartphone, a tablet, a processor, a wearable device, a module, or the like. In addition, computing device 408 may be a processor or module embedded in a wearable device (e.g., wearable device 402), including a sensor, a bracelet, a smart-watch, a piece of clothing, an accessory, and so on. For example, computing device 408 may be substantially similar to devices embedded in wearable device 402, which may be embedded in and removable from earphones 110. Computing device 408 may communicate with other devices via communication medium 404 with or without the use of server 406. In various embodiments, wearable device 402 may be used to perform various processes described herein.

Server 406 directs communications made over communication medium 404. Server 406 may be, for example, an Internet server, a router, a desktop or laptop computer, a smartphone, a tablet, a processor, a module, or the like. In one embodiment, server 406 directs communications between communication medium 404 and computing device 408. For example, server 406 may update information stored on computing device 408, or server 406 may send information to computing device 408 in real time.

Figure 5:
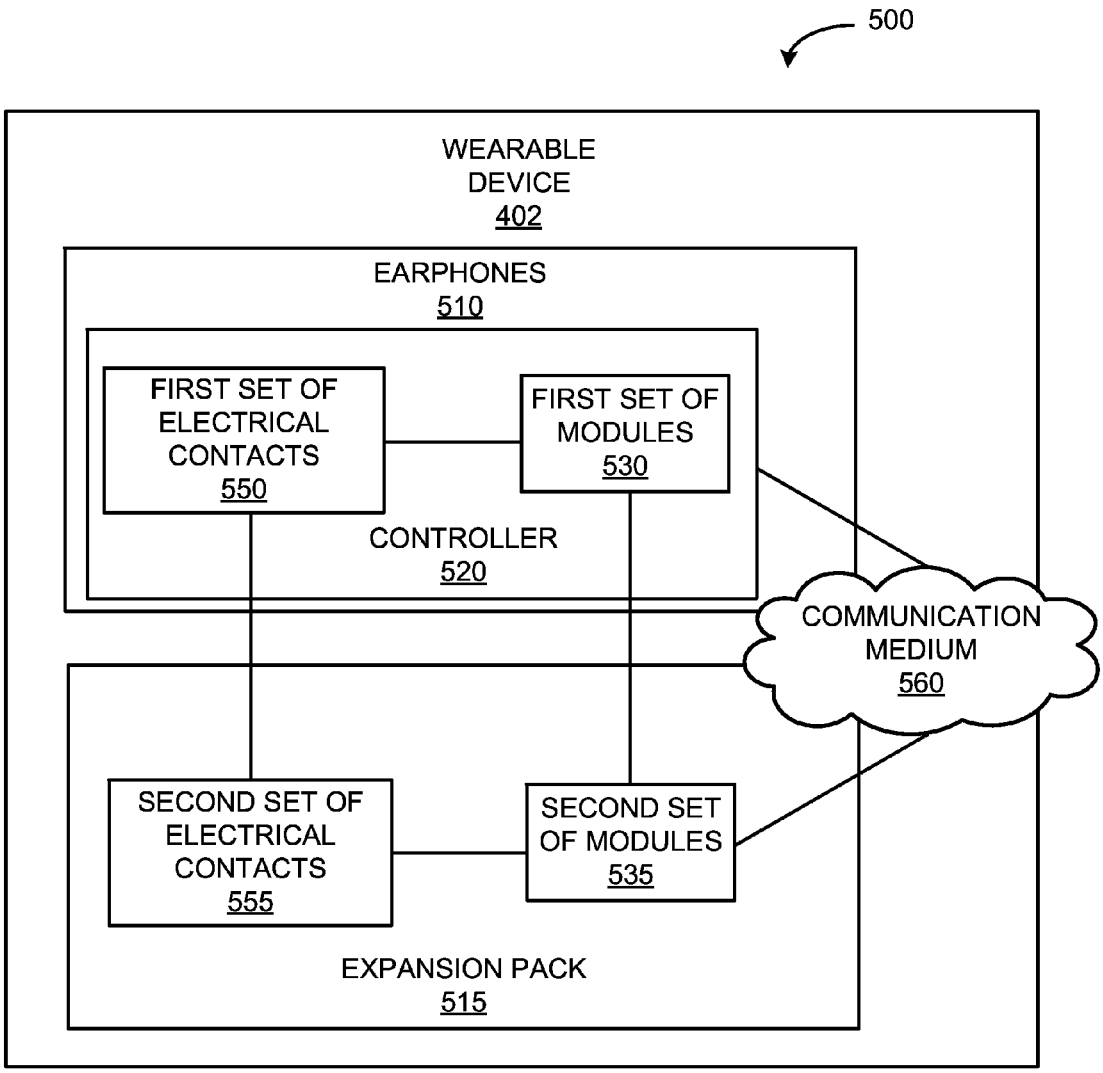
FIG. 5 illustrates a schematic block diagram of an example wearable device.

FIG. 5 is a schematic block diagram illustrating an example embodiment of wearable device 402. Wearable device 402 includes a pair of earphones 510, controller 520, expansion pack 515, and communication medium 550. Communication medium may be substantially similar to communication medium 404, and may communicatively couple earphones 510 to expansion pack 515. Additionally, communication medium 560 may include various wired connections, such that modules in expansion pack 515 may couple to modules in earphones 510 by, for example, direct connect interface (e.g., micro-USB port and the like).

Earphones 510 includes a controller 520 with a first set of electrical contacts 550 and a first set of modules 530. As shown, a first set of electrical contacts 550 is coupled to first set of modules 530 and to the communication medium 560.

Expansion pack 515 includes a second set of electrical contacts 555 and second set of modules 535. As shown, second set of electrical contacts 555 is coupled to a second set of modules 535. In various embodiments, second set of modules 535 is coupled to second set of electrical contacts 555 and to communication medium 560. As first and second sets of modules 530 and 535 are both coupled to communication medium 560, in addition to interacting via electrical contacts 550 and 555, the first set of modules 530 may interact with second set of modules 535 via all forms of communications supported by communication medium 560.

One embodiment of wearable device 402 charges a first battery (e.g., USB energy storage device) in controller 520 connected to the pair of earphones 510 using a second battery embedded in expansion pack 515. In such an embodiment, second set of modules 535 includes the second battery. The second battery may itself be charged by conventional means, such as plugging the expansion pack into an AC outlet, by USB, by wireless charging, and so on. Expansion pack 515 is brought into proximity with controller 520 and is aligned thereto. First set of electrical contacts 550 is properly aligned to the second set of electrical contacts 555. If properly aligned, the first set of electrical contacts 550 makes contact with the second set of electrical contacts 555, further allowing the electrical current to flow from the second battery into the first battery. In instances where the electrical contacts 550 and 555 include electromagnetic material forming a first and second set of electromagnetic contacts, the first set of electromagnetic contacts current may flow from the second battery through one or more electromagnetic contacts and into the first battery. In various embodiments, the first and second set of modules 530, 535 include logic and circuity to control the flow of current between the first and second batteries.

Expansion pack 515, in one instance, provides expanded processing power to a processor in earphones 510. In such an instance, second set of modules 535 may include a second processing means. Expansion pack 514 may be coupled or fastened to be aligned with the controller 520 of the earphones 510 via clasping or attaching mechanisms (e.g., mating components, magnetic fasteners, clasps). First processing means in first set of modules 530 is then coupled to the second processing means via one or more of the electrical contacts 550 and 555, and communication medium 560. In this manner, expansion pack 515 may allow the first processing means to perform functions and capabilities not otherwise possible without the addition of the second processing means.

Expansion pack 515, in another instance, provides cellular capabilities to circuitry in earphones 510. In such an instance, second set of modules 535 includes a cellular transceiver and other means for connecting to a cellular network (e.g., LTE, WiMAX, CDMA, etc.). Communication medium 560 may then transfer cellular data between second set of modules 535 and first set of modules 530.

Accordingly, expansion pack 515 enables various modes of use through which expansion pack 515 expands the capabilities of earphones 510. In various embodiments, earphones 510 detect which mode of use is to be employed based on an orientation of expansion pack 515 relative to earphones 510. For example, if expansion pack 515 is aligned in a particular first orientation (e.g., with a first and a second electrical contact), this may indicate a battery charging mode of use. In this mode, a second battery in expansion pack 515 may, for example, charge a first battery in earphones 510. On the other hand, if expansion pack 515 is aligned in a particular second orientation (e.g., with a first and a second electrical contact), this may indicate cellular mode of use. In cellular mode, a cellular module in second set of modules 535 may provide cellular capability to modules in first set of modules 530.

Modes of use may be triggered using alignment detection signals passed between first and second sets of modules 530 and 535, and/or using one or more electrical contacts 550 and 555 to detect alignment (e.g., by magnetically controlling detection circuits). In an alternative embodiment, modes of use may be selected or configured using an interface on either earphones 510 or expansion pack 515.

Figure 6:
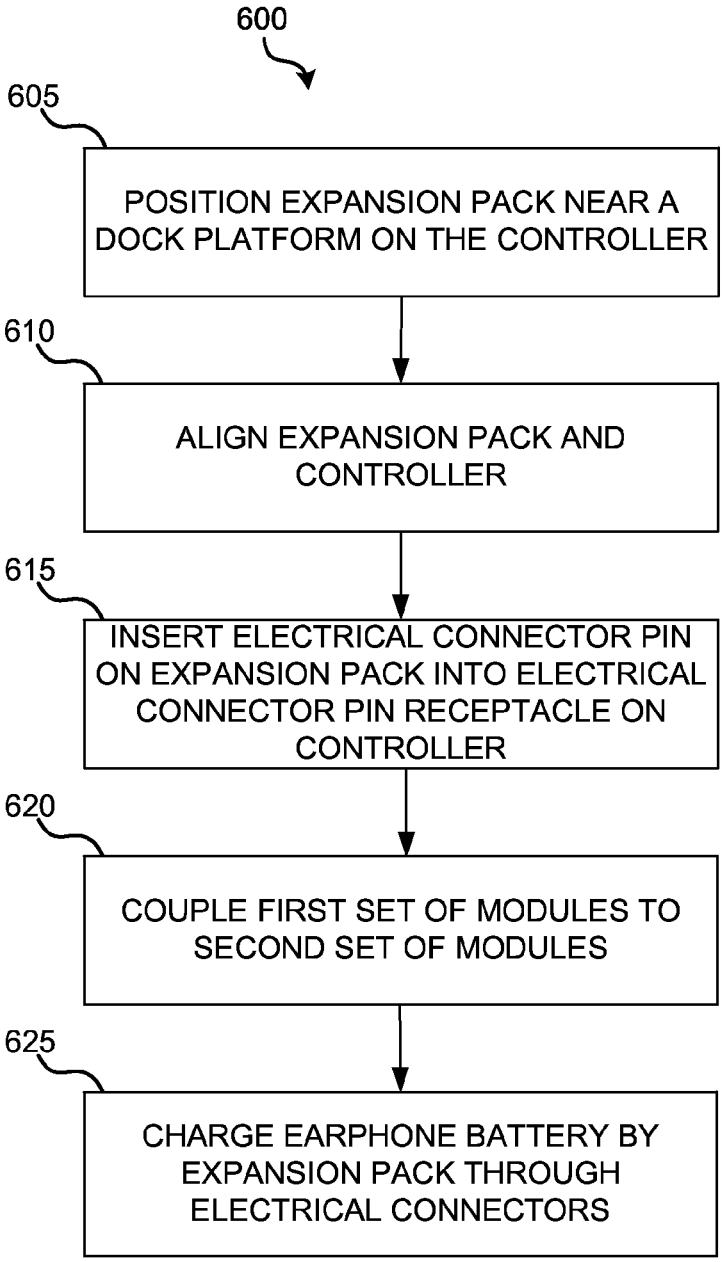
FIG. 6 is an operational flow diagram illustrating an example method for using earphones with an expansion battery pack.

FIG. 6 is an operational flow diagram illustrating an example method for using earphones with an expansion battery pack. One embodiment of method 600 includes fastening the expansion pack to a pair of earphones so that a first battery in the expansion pack may charge a second battery in the earphones. In some embodiments, the second battery may be housed within a controller so that each earphone is attached to the controller by a cable.

At operation 605, method 600 includes positioning the expansion near the dock platform of the controller. At operation 610, method 600 further includes aligning the expansion with the controller of the earphones so that the expansion pack and the controller form a proper form fit. In other embodiments, operation 610 may further include aligning the expansion pack with other areas of the earphones configured to receive the expansion pack. At operation 615, method 600 includes coupling the expansion pack to the controller via the latching or connecting mechanism created between the electrical contacts of the controller and the expansion pack, which may include an electrical connector pin on the expansion pack to be inserted into the corresponding electrical connector pin receptacle on the controller. At operation 620, the coupling of the controller and the expansion pack results in the coupling of the first set of modules of the controller to the second set of modules of the expansion pack. One instance of method 600 includes, at operation 625, charging a battery in the second set of modules (in the expansion pack) by a battery in the first set of modules (in the controller) through the first set of electrical contacts in the controller and the second set of opposing electrical contacts in the controller of the earphones. Additional processes may be performed as described herein in detail with regard to FIGS. 1-6.

The presence of broadening words and phrases such as "one or more," "at least," "but not limited to" or other like phrases in some instances shall not be read to mean that the narrower case is intended or required in instances where such broadening phrases may be absent. The use of the term "module" does not imply that the components or functionality described or claimed as part of the module are all configured in a common package. Indeed, any or all of the various components of a module, whether control logic or other components, can be combined in a single package or separately maintained and can further be distributed in multiple groupings or packages or across multiple locations.

Additionally, the various embodiments set forth herein are described in terms of example block diagrams, flow charts and other illustrations. As will become apparent to one of ordinary skill in the art after reading this document, the illustrated embodiments and their various alternatives can be implemented without confinement to the illustrated examples. For example, block diagrams and their accompanying description should not be construed as mandating a particular architecture or configuration.

While various embodiments of the present disclosure have been described above, it should be understood that they have been presented by way of example only, and not of limitation. Likewise, the various diagrams may depict an example architectural or other configuration for the disclosure, which is done to aid in understanding the features and functionality that can be included in the disclosure. The disclosure is not restricted to the illustrated example architectures or configurations, but the desired features can be implemented using a variety of alternative architectures and configurations. Indeed, it will be apparent to one of skill in the art how alternative functional, logical or physical partitioning and configurations can be implemented to implement the desired features of the present disclosure. Also, a multitude of different constituent module names other than those depicted herein can be applied to the various partitions. Additionally, with regard to flow diagrams, operational descriptions and method claims, the order in which the steps are presented herein shall not mandate that various embodiments be implemented to perform the recited functionality in the same order unless the context dictates otherwise.

Although the disclosure is described above in terms of various example embodiments and implementations, it should be understood that the various features, aspects and functionality described in one or more of the individual embodiments are not limited in their applicability to the particular embodiment with which they are described, but instead can be applied, alone or in various combinations, to one or more of the other embodiments of the disclosure, whether or not such embodiments are described and whether or not such features are presented as being a part of a described embodiment. Thus, the breadth and scope of the present disclosure should not be limited by any of the above-described exemplary embodiments.

What is claimed is:

1. A system, comprising:

a portable wearable device comprising:

one or more cables;

a pair of earphones, wherein each of the earphones are connected to the one or more cables;

a controller fixed to the one or more cables at a location spaced apart from each of the earphones, the controller configured for controlling operation of the earphones, the controller comprising:

a first electrical contact;

a first power source; and a portable, detachable expansion pack attached to the controller, the expansion pack comprising:

a second electrical contact; and a second power source, wherein the first power source is electrically coupled to the second power source when the second electrical contact of the expansion pack is connected to the first electrical contact of the controller, the first power source is configured to be charged by the second power source through the connection between the first electrical contact and the second electrical contact when the earphones are positioned at the ears of a user, and the portable wearable device and the detachable expansion pack are configured to be physically untethered to an external device when the first power source is charged by the second power source and the earphones are positioned at the ears of the user.

2. The system of claim 1, wherein the first electrical contact of the controller and the second electrical contact of the expansion pack are configured to magnetically couple, such that the first electrical contact and the second electrical contact are configured to attract the expansion pack to the controller.

3. The system of claim 1, wherein the expansion pack comprises a Universal Serial Bus (USB) with a USB plug configured to couple to an external power supply source.

4. The system of claim 3, wherein the USB plug is configured to couple to the external power supply source independent of the controller to charge the second power source of the expansion pack.

5. The system of claim 3, wherein the USB energy storage device is configured to connect to the external power supply source with a corresponding USB 1, USB 2, or USB 3 port.

6. The system of claim 1, wherein the controller comprises a dock platform and a dock cover, wherein the dock cover is configured to cover the dock platform when the expansion pack is not coupled to the dock platform.

7. The system of claim 1, wherein the wearable device is configured to enable attaching of the expansion pack to the controller when the earphones are positioned at the ears of the user.

8. The system of claim 1, wherein the controller includes a set of alignment guides and the expansion pack includes a corresponding set of alignment guides configured to align the expansion pack to the controller.

9. The system of claim 1, wherein the expansion pack includes a sensor configured to communicate with a processor in the controller.

10. The system of claim 1, wherein the first power source is configured to be charged by the second power source through the electrical coupling of the first power source to the second power source when the earphones are positioned at the ears of the user during exercise by the user.

11. A method of using a pair of earphones with an expansion pack, the method comprising:

coupling the expansion pack to a controller, wherein the controller is attached to the pair of earphones by one or more cables at a location spaced apart from each of the pair of earphones, the controller and the earphones are part of a portable wearable device, the expansion pack is portable and detachable from the controller, the controller comprises an electrical connector pin receptacle, and coupling the expansion pack to the controller comprises inserting an electrical connector pin located on the expansion pack into the electrical pin receptacle located on the controller, which causes a coupling of a first power source of the controller to a second power source of the expansion pack when the electrical connector pin is inserted in the electrical pin receptacle; and recharging the first power source with the second power source when the earphones are positioned at ears of a user and when the controller, the earphones and the expansion pack are physically untethered to an external device.

12. A method of claim 11, wherein coupling the expansion pack to the controller is performed by magnetic forces between the electrical connector pin and the electrical connector pin receptacle.

13. The method of claim 11, wherein the expansion pack comprises a USB plug configured to connect to an external power supply source to charge the second power source independent of charging the first power source of the controller.

14. The method of claim 13, further comprising inserting the USB plug of the expansion pack coupled to the controller into a corresponding USB port of an external power supply source to provide a charging voltage simultaneously to the controller and the expansion pack.

15. The method of claim 11, wherein coupling the expansion pack to the controller is performed when the earphones are positioned at the ears of the user.

16. A system, comprising:

a portable wearable device comprising, a pair of earphones, a controller, and an attachable expansion pack electrically coupled and fastened to the controller, wherein the controller is spaced apart from and coupled to the earphones by one or more cables, the controller comprises a first electrical contact coupled to a first power source via an electrical connector pin receptacle, the expansion pack comprises a second electrical contact coupled to a second power source via an electrical connector pin such that the first and second electrical contacts electrically couple when the electrical connector pin is inserted into the electrical connector pin receptacle, and the first power source is configured to be charged by the second power source through the coupling between the first electrical contact and the second electrical contact when the earphones are positioned at ears of a user, and the portable, wearable device is configured to be physically untethered to an external device when the first power source is charged by the second power source and the earphones are positioned at the ears of the user.

17. The system of claim 16, wherein the controller further comprises a dock platform configured to receive the expansion pack when the expansion pack is coupled to the controller.

18. The system of claim 16, wherein the expansion pack comprises a USB energy storage device configured to connect to an external power supply source to provide a charging voltage to the controller of the earphones via the first and second electrical contacts when the expansion pack is coupled to the controller.

19. The system of claim 16, wherein the wearable device is configured to enable fastening of the expansion pack to the controller when the earphones are positioned at the ears of the user.

* * * * *